US005113169A

United States Patent [19]

Ruehl et al.

[11] Patent Number: 5,113,169

[45] Date of Patent: May 12, 1992

[54] INDICATING FUSE ASSEMBLY

[75] Inventors: William E. Ruehl, Elgin; Bjarne Frederiksen, Villa Park; E. Grant Swick, Bartlett, all of Ill.

[73] Assignee: Illinois Tool Works Inc., Glenview, Ill.

[21] Appl. No.: 532,393

[22] Filed: Jun. 1, 1990

[51] Int. Cl.[5] ..... H01H 85/30

[52] U.S. Cl. ..... 337/265; 337/267

[58] Field of Search ..... 337/241, 244, 245, 265, 337/267

[56] References Cited

U.S. PATENT DOCUMENTS 3,319,027 5/1967 Hitchcock ..... 337/265
3,665,361 5/1972 Williams ..... 337/265

FOREIGN PATENT DOCUMENTS 345685 1/1937 Italy ..... 337/244
349112 6/1937 Italy ..... 337/244

*Primary Examiner*—Harold Broome
*Attorney, Agent, or Firm*—Schwartz & Weinrieb

[57] ABSTRACT

A fuse assembly has snubber/indicators which are visible through translucent lenses provided within the fuse cover, for indication and inspection of the fuse operability. The snubbers provide a shearing load upon the fuse filament so as to more positively separate the fuse segments of a ruptured filament, which snubbers may also envelop and insulate the conductor posts and separate the ruptured fuse elements so as to inhibit arcing within the "blown" fuse.

40 Claims, 4 Drawing Sheets

FIG. 1
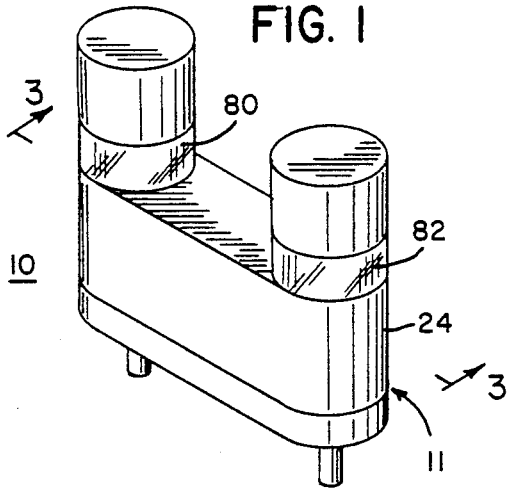
FIG. 3
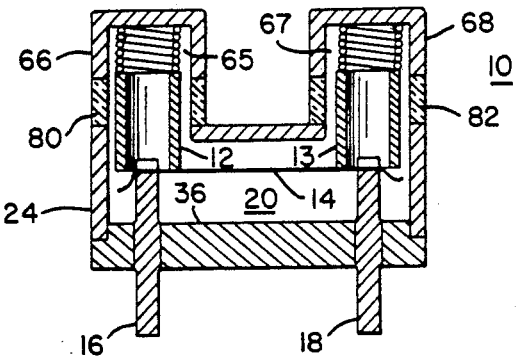
FIG. 4
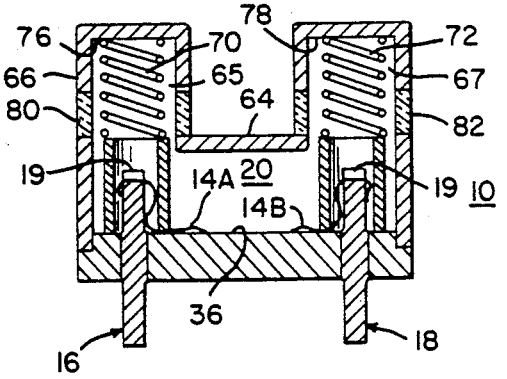
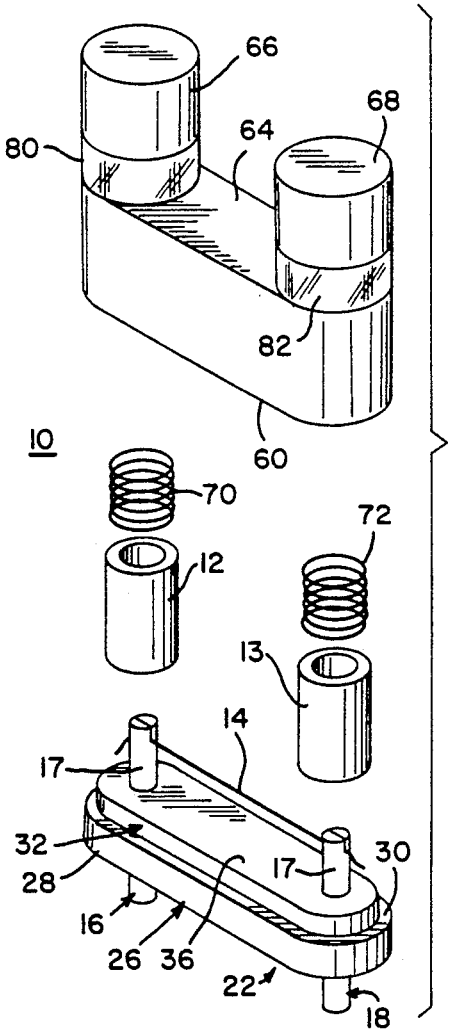
FIG. 2
FIG. 5
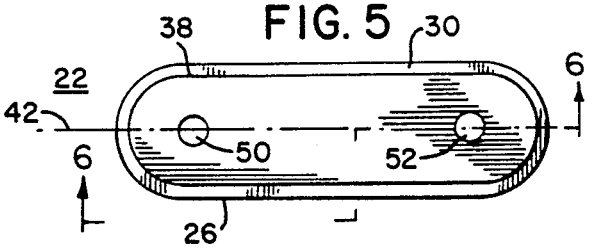
FIG. 6
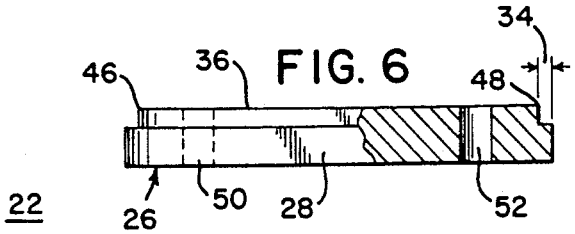

INDICATING FUSE ASSEMBLY

FIELD OF THE INVENTION

The present invention relates to fuse assemblies and more specifically to a plug-in fuse assembly with a fuse element mounted between conducting posts or terminals with snubbers contacting the fuse element, which snubbers provide a shearing load and insulate or inhibit arcing between the components of a ruptured fuse element within the fuse housing. The fuse structure is provided within a compact assembly for use within, low-current electrical or electronic circuits where the fuse assembly is generally an insert within the electrical or electronic circuit. The fuse structure is readily assembled, exhibits low-cost and is easily evaluated for operability.

BACKGROUND OF THE INVENTION

A fuse or fuse element with indicators is illustrated by, means of the cartridge-type fuse disclosed within Gaia U.S. Pat. No. 4,058,784 , which has both a stationary current-conducting member and a movable current-conducting member, normally joined together by means of a connector, such as, for example, a mass of heat-softenable alloy. An indicator is connected to the movable member and has a spring, which can simultaneously move the movable member and indicator to a second position when the circuit-interrupter, that is, for example, the fuse, ruptures. In the illustrated embodiment, a small arm with a positive stop or knob is extended from the end of the cartridge under the biasing fuse of the spring at the time of the fuse-element rupture.

An elongated fuse or cartridge housing as disclosed within Urani U.S. Pat. No. 4,511,876 has a fusible wire disposed within the housing and is coupled to a spring indicator or terminal at one end and is secured to the opposite terminal end for conduction through the cartridge. The spring indicator unit is housed within one end of the cylindrical housing and biases the section of the ruptured fuse element connected to the indicator coil through the opening. Thus, fuse inoperability, and more specifically, an open circuit, is indicated.

Fahnoe U.S. Pat. No. 4,186,365 discloses a high-voltage fuse, which utilizes a movable component, such as, for example, an arcing rod, which is movable through an arc-extinguishing medium from a first and fuse-operable position to a second fuse-inoperable position. The fusible element arcing rod and arc-extinguishing medium are contained within a translucent insulative housing for the fuse. However, the condition of the fuse is difficult, if not impossible, to observe in either one of its blown or intact conditions from a position exterior to the fuse. Thus, a colored member is mounted for movement along with the arcing rod so as to provide a readily visible image through the translucent housing.

An electric fuse disposed within a tubular casing of insulating material in Link U.S. Pat. No. 4,323,874 has a pair of terminal caps mounted upon its ends so as to seal the tube. A fuse link connects the terminal caps and the fuse-link is embedded within an arc-quenching filler material disposed within the casing. A fuse indicator in an indicator housing is supported upon one of the end caps and has a spring-biased, pin-type indicator for piercing a cover plate at fuse rupture. The indicator is coupled to a pair of members of a non-conductive material, which members have a plurality of holes or notches with a fusible wire threaded through the holes so as to prevent relative movement between the members. One of the non-conductive members is supported by means of the housing and the other member is connected to the indicator for release of the movable member upon fusing of the wire connector and release of the indicator to its blown-fuse indicating position.

A delayed action indicator fuse is disclose within Goodwin U.S. Pat. No. 2,274,059 . This fuse is generally not responsive to transient, relatively low overloads, but requires continued overloads of a duration indicative of a defective line condition. The overload indicator disposed within an insulating cap is spring-biased so as to move a heating coil to fracture and move an indicator sign with the words, "no good", to a position opposite to a translucent window at the fuse end.

A low-voltage fuse with a blown-fuse indicator, shown within U.S. Pat. No. 3,783,428-Swain et al., has a molded insulating casing and a releasable plunger for indicating the blown-fuse condition. The indicator is recessed into the body of the casing and secured across the fuse structure by means of a fusible restraining wire. The indicator is biased and displaceable from the fuse body at upon rupture of the fuse element and release of the restraining wire. The indicator is displaced so as to provide maximum possible separation from the general structure of the fuse element, and thus eliminate potential arcing by means of the conductors.

Other indicating fuse structures are disclosed within U.S. Pat. No. 2,234,480-Schmidt; U.S. Pat. No. 1,337,357-Holdorf; U.S. Pat. No. 3,319,027-Hitchcock; U.S. Pat. No. 4,156,225-Cuzzone; and U.S. Pat. No. 4,023,133-Knapp, Jr., which patents generally provide an external indicator for indicating the blown-fuse condition. More specifically, in the above-noted patents only Schmidt-'480 discloses an internally retained fuse indicator disposed within a translucent window at the upper surface of the fuse, which indicator is spring-biased upwardly from the fuse base. The remaining patents disclose a physically displaceable indicator means secured within either the main body of the fuse or within an indicator retainer, which indicator is externally visible after the blown fuse condition occurs.

SUMMARY OF THE INVENTION

A fuse assembly for ready insertion into an electrical circuit has an indicator for indicating the operability or inoperability of the fuse within the circuit, which indicator is retained within the assembly. The indicating means promotes the isolation of the fuse element segments so as to inhibit arcing and short circuits within the blown fuse. The assembly housing includes lenses for observation of the indicators and review of the operability of the fuse. The structure provides the indicators at a reference position and indicator displacement from this reference position to the fuse-blown condition provides the user with an observable event so as to indicate the blown condition.

The fuse element in the assembly is secured between conductor posts. The indicators or snubbers are generally positioned above the conducting posts and are biased so as to contact the fuse element, which places a shearing load upon the fuse element. Rupture of this fuse element and movement of the snubber/indicator moves the blown fuse segments closer to the respective conductor posts so as to separate the ruptured segments of the fuse element and inhibit arcing within the fuse assembly.

BRIEF DESCRIPTION OF THE DRAWINGS

Various objects, features, and attendant advantages of the present invention will become more fully appreciated from the following detailed description of the invention, when considered in connection with the accompanying drawings, in which like reference characters designate like or corresponding parts throughout the several views, and wherein:

FIG. 1 is a perspective view of a preferred embodiment of an indicating fuse assembly constructed in accordance with the present invention;

FIG. 2 is an exploded view, in perspective, of the assembly of FIG. 1;

FIG. 3 is a cross-sectional illustration of the preferred embodiment of FIG. 1 along the line 3—3;

FIG. 4 is a cross-sectional elevational view as noted in FIG. 3, illustrating, however a fuse-blown condition;

FIG. 5 is a plan view of the base of FIG. 2;

FIG. 6 is an elevational view in partial section of the base in FIG. 5 taken along line 6—6;

DETAILED DESCRIPTION OF THE PREFERRED EMBODIMENTS

Figure 7:
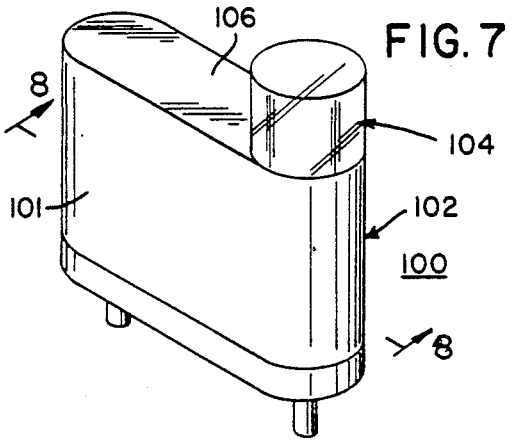
FIG. 7 is a perspective view of an alternative embodiment of a fuse assembly constructed in accordance with the principles of the present invention.

A fuse assembly 10 for an electronic circuit with narrow physical parameters is illustrated in FIGS. 1–4, with a fuse element 14 extending between first conducting post 16 and second conducting post 18 within chamber 20 of housing 11. First and second snubbers or indicators 12, 13 are located above posts, 16, 18, respectively, within housing 11 and at a reference position. Fuse assembly 10 is generally insertable within an electrical circuit or socket (not shown) for circuit completing purposes as well as protection of the circuit and the components therein from an overcurrent condition and is particularly adaptable to low-current applications.

Generally elongate base 22 of housing 11, as particularly shown in FIGS. 5 and 6, is fabricated from an electrically nonconductive material with a lower wall 26 with outer surface 28 and upper surface 30. A second or upper wall 32, which may be similarly shaped but shorter than wall 26, is positioned upon upper surface 30 with a peripheral lip or gap 34 defined upon upper surface 30 and between lower-wall outer surface 28 and upper wall perimeter 38. Lip or gap 34 provides a footing for cover 24, which encases upper wall 32 within inner chamber 20. First and second through-bores 50 and 52 for conductor posts 16 and 18, respectively, extend through upper and lower walls 26 and 32, and are generally aligned along the base longitudinal axis 42. Posts 16, 18 may be secured within base 22 by any means known in the art including molding base 22 about posts 16, 18. As noted in the FIGS. 1–29, assembly 10 may have varying shapes, but is generally oblong with either arcuate or square ends, but these unit shapes are exemplary and not a limitation with respect to the present invention or with respect to the fuse-assembly operation thereof.

Assembly cover 24 has a chamber 20 and lower surface 60 generally conforming in its configuration to lip 34 and upper-wall perimeter 38 so as to define chamber 20 between cover upper surface 64 and top surface 36 of wall 32. First tower or well 66 and second tower 68 of cover 24 extend above cover upper surface 64 at either end 46 and 48 of second wall 32, and are generally aligned with bores 50 and 52, respectively. These cylindrical wells 66, 68 have cavities 65 and 67 which open into chamber 20 so as to receive indicators 12 and 13, respectively, which are secured within cavities 65, 67 at the reference position by means of fuse element 14 above conductors 16 and 18.

Cover 24 and base 22 may mate and be hermetically sealed for certain commercial or industrial applications or for meeting the testing standards of certain independent testing laboratories. In addition, fuse assembly 10 may be filled with a dielectric fluid, such as, for example, transformer oil or a silicon fluid, so as to further inhibit the potential for arcing, however, fuse assembly 10 is operable without such a hermetic seal or additional fluid. Although pure water may be utilized as the contained fluid, it should only be utilized in cooperation with a housing of appropriate material so as to avoid vapor transmission. The fuse assembly is operable either within an AC or DC circuit and has been tested at 600 volts, although contemporary low-current fuses are operable only up to approximately 125 volts at the same current level. However, a similarly sized fuse assembly 10 with a dielectric fluid is operable up to 350 amperes at 600 volts AC, although an Underwriters' Laboratories specification is only 40 amperes at 600 volts AC.

Figure 28:
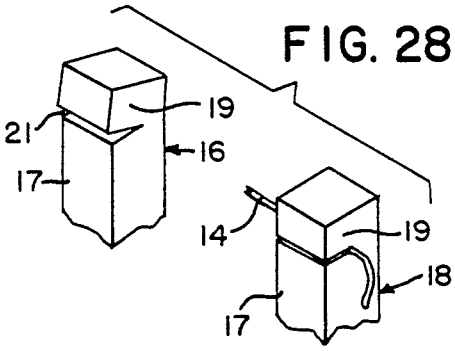
FIG. 28 is a perspective illustration of a mounting post arrangement.
Figure 29:
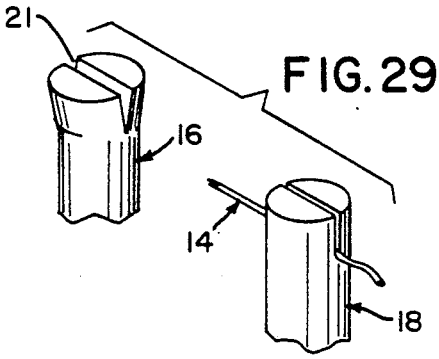
FIG. 29 is an alternative embodiment of a mounting post arrangement.
Figure 27:
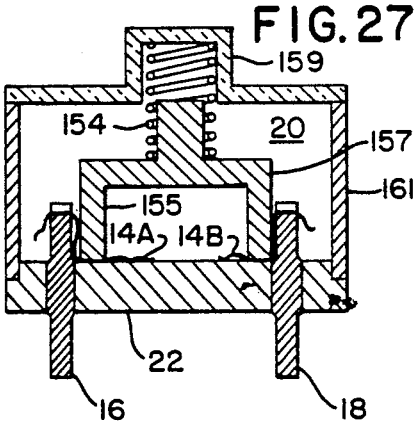
FIG. 27 illustrates the fuse assembly of FIG. 26 in its blown-fuse condition.

Fuse element 14 is secured between posts 16 and 18 within chamber 20 so as to conduct electricity up to a predetermined electrical power load, and will rupture or "blow" above a predetermined current value so as to open and protect a circuit. Fuse element 14, which may be an iron-nickel alloy for example, is rigid enough to avoid line sag, and is securable within notch 21 defined within each of posts 16 and 18, as best seen in FIG. 27, without applying a tensile load to element 14. Each of the illustrated posts 16 and 18 in accordance with the several embodiments has a vertical or horizontal notch 21 defined at its upper end and a vertically extending shaft 17 fixed base 22 by means known in the art, such as, for example, thin insert molding or press-fit splines. The depth of notch 21 defined within posts 16, 18 as seen within FIG. 28 is approximately one-third to two-thirds of the cross-sectional dimension or thickness of the post. A hinged cap 19 is thus formed at the upper end of each post 16 or 18 and is compressible against lower shaft 17 so as to secure fuse element 14 in notch 21. Alternatively, notches 21 shown in FIG. 29 are vertically oriented within posts 16, 18 so as to secure fuse element 14 therein, or element 14 may be secured within post 16 and 18 by the crimping the notch closed. Fuse element 14 may otherwise be secured to post 16 other by means known in the art.

In FIGS. 1–4, snubbers 12 and 13, which are operable as both a "blown" fuse separator and an indicator, are generally illustrated as cylinders, however, the particular shape of the snubber is not a limitation. The snubber wall is located within approximately four wire diameters of the conductor post, but is equally operable when it is spaced from the conductor post by means of a distance of up to at least twenty-five percent of the filament length. Bias springs 70 and 72 are positioned within wells 65 and 67 such that the upper ends of the springs 70 and 72 are disposed against upper surfaces 76 and 78 of towers 66 and 68, while the lower ends of the springs 70 and 72 are disposed in contact with snubbers 12 and 13 so as to bias snubbers 12, 13 against fuse element 14, which contact provides a shearing force upon element 14 so as to rapidly wipe and induce maximum separation between wire segments 14*a* and 14*b* of ruptured wire 14 as best seem in FIG. 4. As an example, the spring load is approximately one-fourth of the shear load of the filament, but the spring load only has to be adequate so as to move the snubber in order to wipe the filament segments. The magnitude of the spring load in one case is only 0.05 pounds force for a fully compressed spring.

Cylindrical towers 66, 68 are provided with lenses 80, 82 to for visually inspecting the position of snubbers 12, 13 and evaluate the operability of fuse 10, which lenses 80 and 82 are shown as translucent annuli at or about upper surface 64 of cover 24. Snubbers 12, 13 may be colored to provide a more visible indication of the condition of fuse 10, that is, to visually indicate either an operable or inoperable condition. A clear or transparent plastic with a matte finish may be utilized as the material for cover 24, and lenses 80, 82 would be compatible or integral with this material for ease of manufacture. Lenses 80, 82 are transparent so as to visually monitor the position, of snubber/indicators 12 and 13 at the reference and fuse-operable position. The several other components, that is base 22 and indicators 12 and 13, may also be fabricated from a plastic, dielectric or other insulating material. In the alternative, cover 24 may be a one-piece molded plastic component.

Fuse assembly 10 generally couples and closes an electrical circuit and protects the circuit from an overcurrent condition as a result of the rupture of element 14 so as to open the circuit. Fuse element 14 ruptures at a power or current level determined by means of its physical and electrical properties. However, arcing may occur between t he segments 14*a* and 14*b* of ruptured fuse element 14 and thus it is desirable to maximize separation of segments 14*a* and 14*b*. As a fuse generally operates so as to interrupt current flow in order to prevent damage to the electrical circuit (not shown), continued arcing within a blown fuse may lead to smoke, fire or other hazards. In fuse assembly 10, springs 72 and 74 bias snubber/indicators 12, 13 so as to provide a shearing force upon fuse element 14, which wipes filament segments 14*a*, 14*b* so as to effect a rapid and maximum separation of the filament segments within housing 20 in order to inhibit or minimize the probability of arcing. This assures the proper and safe functioning of fuse 10 for its intended purpose.

Figure 23:
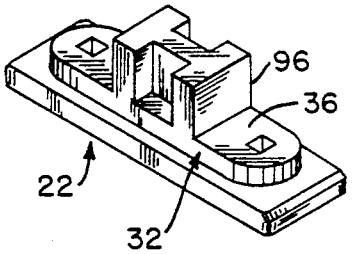
FIG. 23 is a perspective view of an assembly base with a pedestal or projection.
Figure 24:
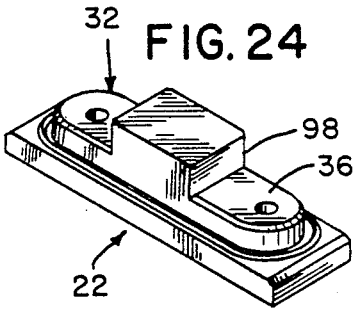
FIG. 24 is an alternative embodiment of a pedestal or projection provided upon the assembly base.

As a thin film of conductive material may be deposited upon the surfaces of chamber 20, such as by filament vaporization or carbonization of the housing surface, it has been found desirable to further increase separation of fuse segments 14*a*, 14*b* by providing a means to extend the separating distance defined between the fuse segments. Illustrative of such distance separation extension means are pedestals or projections 96 and 98 defined upon base second wall 32 as best seen in FIGS. 23 and 24. Fuse element 14 is normally disposed above pedestals 96, 98 but upon the occurrence of fuse rupture the fuse segments 14*a*, 14*b* contact upper surface 36 of second wall 32. Thus any arc between fuse segments 14*a* and 14*b* would be required to traverse pedestal 96 or 98. The physical impact of pedestal 96 or 98 is to therefore increase the tracking or arcing defined path between segments 14*a* and 14*b*.

Indicator/snubbers 12 and 13 are shown as cylinders positioned above conducting posts 16 and 18, and are visible through means of lenses 80 and 82, respectively. Upon the occurrence on a blown condition, indicators 12, 13 move downwardly into chamber 20 and envelop or encompass upper ends 17 of conducting posts 16, 18. Indicators 12, 13 wipe and further separate the ruptured fuse element segments 14*a* and 14*b* attached to respective posts 16, 18, which inhibits any indiscriminate arcing tending to occur therebetween. The insulating characteristic of snubbers 12, 13 also insulates upper ends 17 of conducting posts 16, 18 and effectively isolates them so as to inhibit any extraneous arcing tending to occur between posts 16, 18 within chamber 20. However, it is recognized that the separate component snubbers 12, 13 could also be fabricated from a conductive material as their primary function is to enhance fuse segment separation. Thus, fuse assembly 10 is operable so as to protect the electrical circuit, minimize the potential for arcing and provides these features within a minimally sized assembly for use written an electronic circuit or upon a circuit board.

Figure 8:
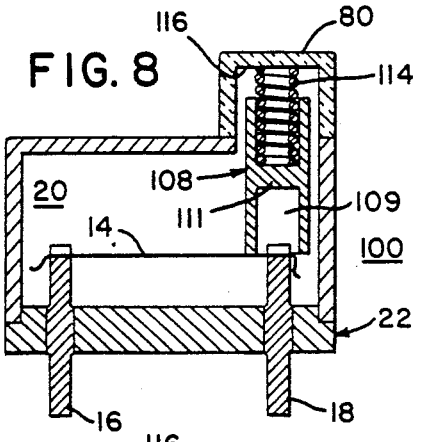
FIG. 8 is a cross-sectional, elevational view of the alternative embodiment of FIG. 7 along the line 8—8, illustrating the fuse assembly in its intact condition.
Figure 9:
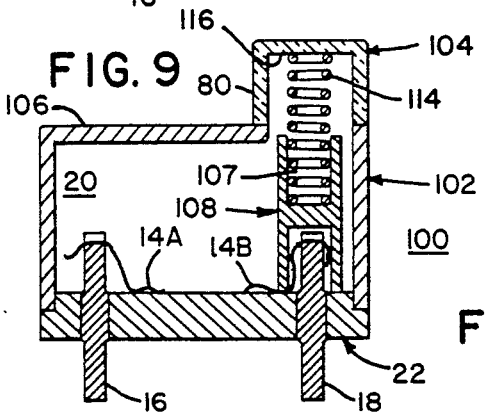
FIG. 9 is a cross-sectional, elevational view of the assembly of FIG. 8 illustrating the blown-fuse condition.

In FIGS. 7–9, an alternative embodiment 100 of the fuse assembly has a cover 102 with a single tower or well 104 defined at the first or second end of base 22. Cover 102 has a broad sidewall 101 and an upper surface 106 extending from tower 104 toward the opposite end of cover 102.

Lens 80 may be provided within either the top wall 116 or sidewall of well 104, and snubber/indicator 108 will be accordingly visible to the user for inspection of fuse assembly 100. A lens or light pipe within top wall 116 of any of the cover towers may be provided so as to amplify the presence of a snubber in order to enhance visual inspection of fuse assembly 10. The single snubber/indicator 108 within chamber 20 and well 104 has a generally outer cylindrical shape with blindhole bores 107, 109 extending into the body of the cylinder from either end thereof and terminating at separating wall 111 as best seen in FIGS. 8 and 9. Lower blindhole bore 109 is positioned over conductor rod 18 and is secured in position at the reference position in FIG. 8 by being disposed fuse element 14. Bias spring 114 within well 104 has its upper end tower upper wall 116 in contact with and extends downwardly into blindhole bore 107 so as to bias indicator 108 its lower end downwardly against fuse 14. Assembly 100 minimizes the number of required snubber/indicators 108 and bias springs 114 so as to reduce the cost of the subassemblies or parts comprising assembly 100. At the fuse-ruptured position noted in FIG. 9, bias spring 114 continuously biases indicator 108 against base 22 so as to wipe and secure ruptured fuse segment **14*b* at a separated position with respect to 14*a*, and blindhole bore 109 envelops upper end 17 of conducting post 18 within chamber 20**.

Figure 9A:
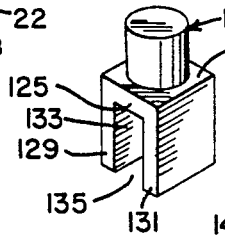
FIG. 9A is an alternative embodiment of the snubber-/indicator noted in FIG. 9.
Figure 13:
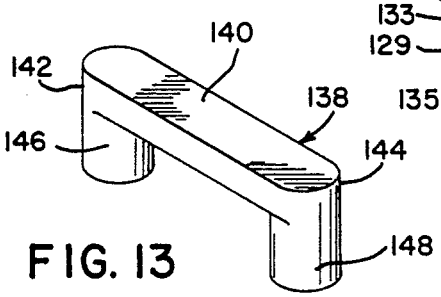
FIG. 13 illustrates a snubber/indicator for use within the fuse-assembly of FIG. 10.

Alternative snubber 121 shown in FIG. 9A has stub or upright post 123 extending normal or perpendicular to top surface 127 of wall 125. Parallel sidewalls 129, 131 extend downwardly from lower surface 133 of wall 125 and have a gap 135 defined therebetween. Upright post 123 is positioned within tower 104 with spring 114 interposed between snubber 121 and tower top wall 116, wherein the lower end or spring 114 may surround post 123. One of the sidewalls 129, 131 contacts and wipes the ruptured fuse element at post 18, which post is matable with gap 135. Of course it is apparent the particular shape and form of snubber 12, 13, 108 or 121 is not a limitation, as their primary function is to maximize the separation of fuse segments **14*a* and 14*b*** and not to capture the aligned conductor post.

Figure 10:
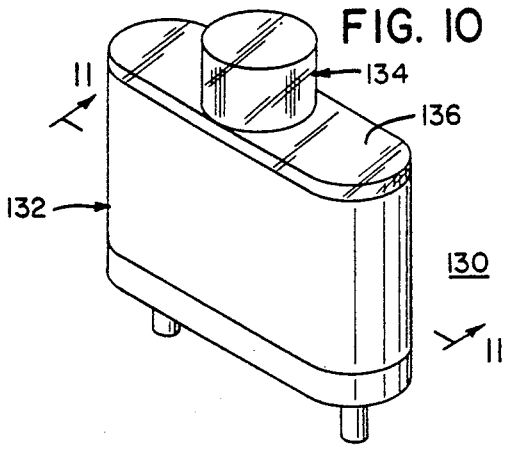
FIG. 10 is a perspective view of a second alternative embodiment of the fuse assembly constructed in accordance with the present invention.
Figure 11:
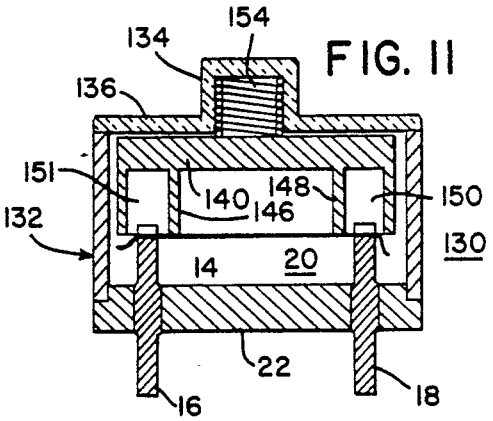
FIG. 11 is a cross-sectional elevational view of the alternative embodiment of FIG. 10 taken along the line 11—11, illustrating the fuse assembly in its intact condition.
Figure 12:
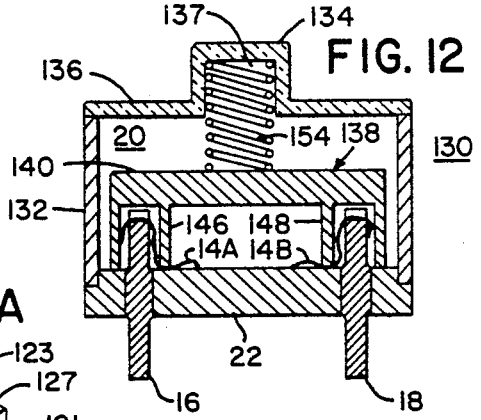
FIG. 12 illustrates the fuse assembly of FIG. 11 when in its blown-fuse condition.

A second alternative embodiment 130 of, fuse assembly 10 is shown in FIGS. 10–12 and comprises cover 132 having a substantially centrally located tower 134 located upon cover upper surface 136, wherein the tower is open to chamber 20. Snubber/indicator 138 in FIGS. 13 and 14 has an upper arm 140 with cylindrical end caps 146, 148 extending downwardly from ends 142, 144, respectively. End caps 146, 148 have longitudinal blindhole bores 150, 151 which open downwardly at their free ends, and which end caps are positioned within chamber so as to be disposed over conducting posts 16 and 18, respectively, and which are secured at the reference position upon filament 14, as illustrated within FIG. 11. Biasing spring 154 in well 137 contacts arm 140 and biases end caps 146, 148 against fuse element 14 at the reference position. End caps 146, 148 mate with and envelop conducting posts 16, 18 upon fuse element rupture, and separate fuse segments **14*a* and 14*b* so as to inhibit arcing within chamber 20. As noted in FIG. 12, bias spring 154 continuously biases indicator 138 downwardly so as to maintain it in position over conducting posts 16 and 18** under the fuse-blown condition, as do all the bias springs in the several embodiments.

Figure 14:
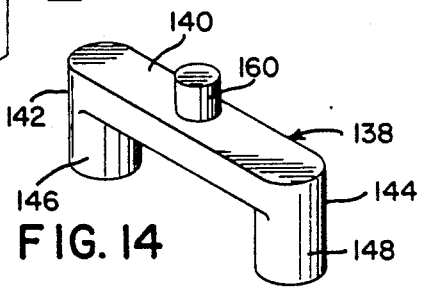
FIG. 14 illustrates an alternative snubber/indicator embodiment for use within the fuse assembly of FIG. 10.

An alternative structure of snubber/indicator 138 is illustrated in FIG. 14 with upright post 160 extending normal or perpendicular to arm 140 for positioning within well 137 of tower 134. Post 160 is utilized as a guide and/or bushing for stabilizing indicator 138 within well 134 at the reference position, and to fixedly locate extended spiral spring 154 upon the upper surface of indicator 138 at the fuse-blown position. In this embodiment, upper surface 136 and well 134 of cover 132 are provided as translucent or transparent components for permitting visual inspection of fuse assembly 130 so as to detect a fuse-blown condition indicated by means of the displacement of indicator 138.

Figure 25:
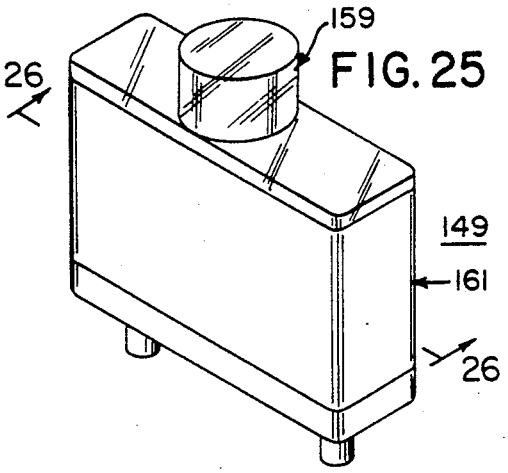
FIG. 25 is a perspective view of an alternative embodiment of the fuse assembly constructed in accordance with the present invention.
Figure 26:
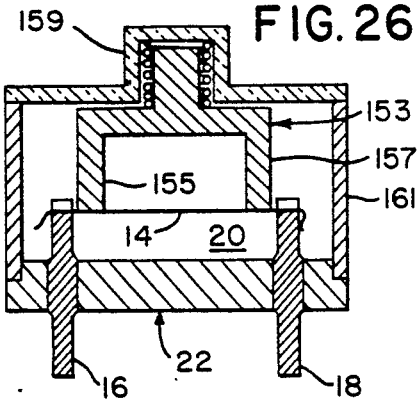
FIG. 26 is a cross-sectional elevational view of the embodiment of FIG. 25 along the lines 26—26 and illustrating the fuse assembly in its intact state.

In FIGS. 25–27, a similar fuse assembly 149 has a rectangular plan-view shape and snubber/indicator 153 is shaped similarly to snubber 121 of FIG. 9A. However, it is noted that sidewalls 155, 157 span the gap between and are disposed in proximity to conducting posts 16, 18 so as to simultaneously wipe both ruptured fuse segments **14*a*, 14*b* and amplify the segment separation. Tower 159 of cover 161 may be a light pipe for facilitating visual inspection of the snubber 153** position within the assembly.

Figure 15:
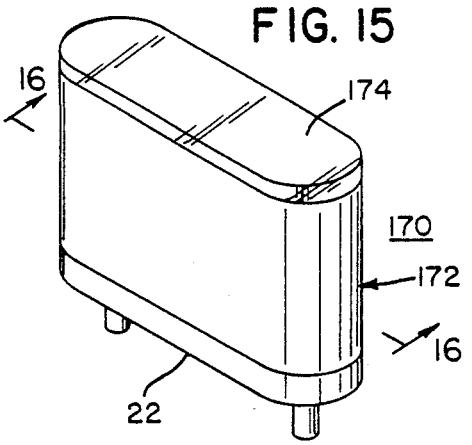
FIG. 15 is a perspective view of a third alternative embodiment of the fuse assembly constructed in accordance with the present invention.
Figure 19:
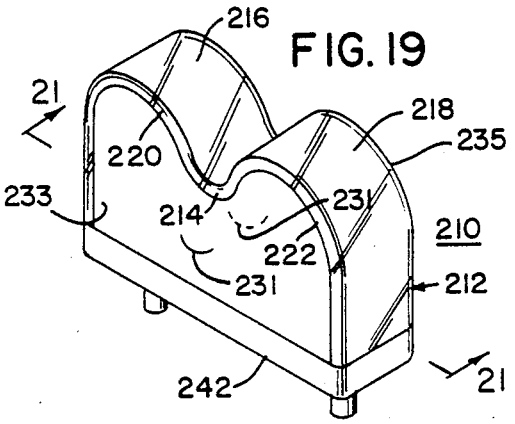
FIG. 19 is a perspective view of a fourth alternative embodiment of the fuse assembly constructed n accordance with the present invention.
Figure 16:
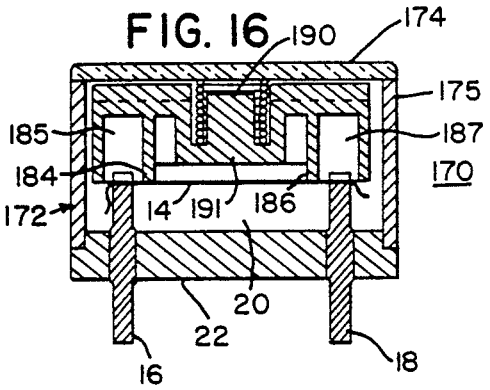
FIG. 16 is a cross-sectional elevational view of the fuse assembly embodiment of FIG. 15 taken along the line 16—16 and showing the fuse assembly in its intact condition.
Figure 17:
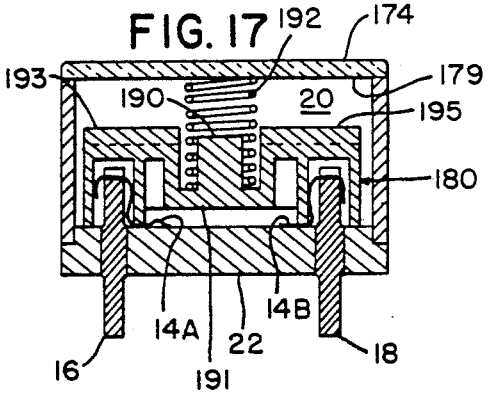
FIG. 17 illustrates the fuse assembly of FIG. 16 when in its blown-fuse condition.

A third alternative embodiment 170 of fuse assembly 10 is illustrated in FIGS. 15–17, and incorporates a more easily assembled and formed housing 11 having cover 172 without a separate well or tower. Cover 172 has an upper wall 174, which is generally oblong with arcuate ends, and an outer wall 175 extending perpendicular to upper wall 174. Upper wall 174 is also a lens, which minimizes or eliminates the construction of extending or protruding towers and facilitates merging of a lens into the cover, as noted in the earlier alternative structures.

Figure 18:
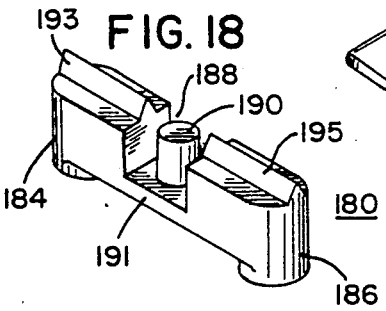
FIG. 18 illustrates the snubber/indicator of FIG. 17.

Snubber/indicator 180 in FIG. 18 has an oblong saddle-like structure with arcuate ends and end caps 184, 186 at either end, as noted in FIGS. 16–18. Blindhole bores 185, 187 within end caps 184, 186 are aligned so as to mate with conducting posts 16, 18, respectively upon rupture of fuse element 14. Post 190 within recess 188 defined between end caps 184, 186 normally extends upwardly from snubber bridging section 191 with bias spring 192 coiled about post 190 and contacting upper surface 173 of window or wall 174 so as to bias snubber/indicator 180 against filament 14 at the reference position. Reflectors 193, 195 disposed atop end caps 184, 186 improve the reflection of snubber 180 within chamber 20, which enhances and facilitates visual inspection of fuse assembly 170. At the fuse-ruptured state, conducting posts 16, 18 are quickly encompassed within blindhole bores 185, 187, and fuse segments **14*a* and 14*b*** are wiped and separated so as to inhibit arcing within chamber 20.

Another alternative embodiment of fuse-assembly 10 is illustrated in FIGS. 19–22, which fuse assembly 210 comprises cover 212 with a double arched outline, and rectangular base 242. Bridging saddle or U-shaped coupling 214 is provided between the arches. Upper surfaces 216 and 218 of respective arches 220 and 222 may be a transparent lens for observing the position of snubber/indicator 219 and for inspecting the operability of fuse 210.

Figure 20:
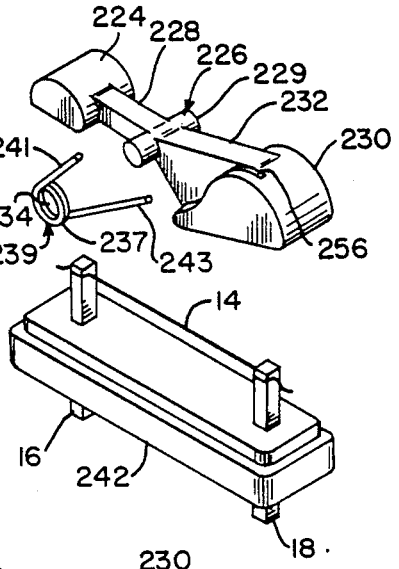
FIG. 20 is an exploded perspective view of the base, fuse element, bias spring and indicator of the alternative embodiment of FIG. 19.

Snubber/indicator 219 in FIG. 20 has a first small end cap 224, which is shown as a longitudinal section of a cylinder, attached to a central pivot 226 by means of an arm 228. Second and larger end cap 230 is similar in shape to end cap 224, and is attached to central pivot 226 by means of an arm 232, which generally extends longitudinally from first arm 228 and pivot 226. Pivot 226 is a cylindrical rod with first and second ends 227, 229 which are positionable within mounting or pivot slots 231 defined within sidewalls 233, 235 of cover 212. Torsional spring 239, which biases end caps 224, 230 within chamber 20, has a loop 237 with pivot port 234 for mounting upon pivot 226, and has first spring arm 241 and second spring arm 243.

Figure 21:
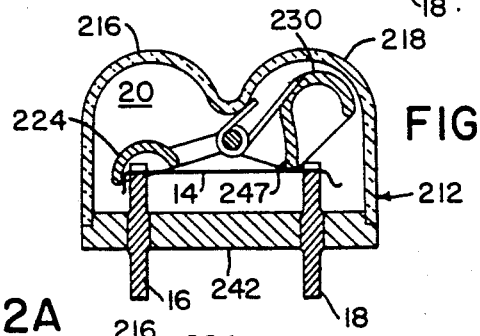
FIG. 21 is a cross-sectional elevational view of the alternative embodiment of FIG. 19 taken along the line 21—21 and illustrating the fuse assembly in its intact condition.

In the reference position shown in FIG. 21, first end cap 224 is biased to a noncontacting position but in proximity to conducting post 16, and filament 14; and, second cap 230 is pivoted upwardly in proximity to upper surface 218 of lens cover 212 and secured in position as a result of contact of foot 247 with fuse element 4. Upon the occurrence of fuse rupture, bias means 239 biases second end cap 230 downwardly so as to envelop second end post 18 with its extending foot 247 contacting base 242. Simultaneously first end cap 224 is pivoted into proximity of lens 216 within first arch 220 for viewing by means of the user. In this embodiment, it is contemplated that first end cap 224 would be a distinctive color, such as, for example, red, to serve as an indicator and readily represent a ruptured fuse element 14. Alternatively, second end cap 230 would be distinguished by means of a separate color, such as green, to indicate an operable fuse 210.

Figure 22A:
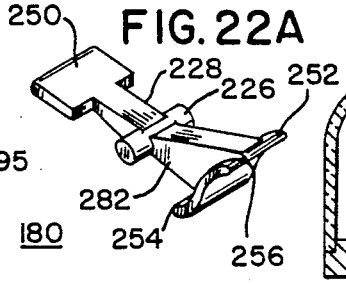
FIG. 22A is an alternative embodiment of the snubber/indicator utilized within the embodiment of FIG. 20.
Figure 22:
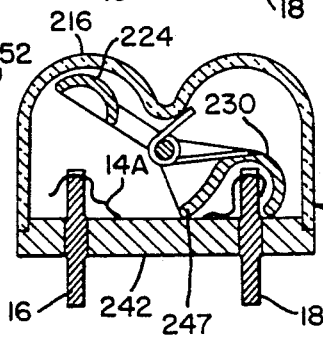
FIG. 22 illustrates the fuse assembly of FIG. 21 in the blown-fuse condition.

An alternative embodiment of snubber 219 is illustrated in FIG. 22A, where first end cap 250 is a generally rectangular paddle and second end cap 252 is a rectangular paddle with a serpentine or wavy edge. Lower foot 254 provides contact with fuse 14 at the reference position. Although the ruptured fuse segment **14*b* is again wiped and separated from segment 14*a*, it is not necessary to capture or enclose the conducting post. Notch 256 defined within second end cap 252 secures arm 243 of spring 239**.

Although the use of plastics for the above insulating covers, bases and snubbers has been noted, alternate materials, such as, for example ceramics, may be utilized. Alternate color schemes and lenses, with or without light pipes in various positions, are impliedly available to the designer in any of the above-noted embodiments of fuse assembly 10.

While only specific embodiments of the invention have been described and shown, it is apparent that various alterations and modifications can be made thereto. It is, therefore, the intention in the appended claims to cover all such modifications and alterations as may fall within the scope and spirit of the invention.

What is claimed is:

1. A fuse assembly for an electrical circuit, comprising:

a housing having a chamber and a wall with an external surface;

a fuse element rupturable at an electric current level above a predetermined current level;

a first conducting post and a second conducting post, each of said conducting posts having a first end and a second end, at least one of said first and second ends of each of said posts having means for securing said fuse element thereto;

said first and second conducting posts extending through said wall with said fuse-securing-means end positioned within said chamber and the other one of said ends operable to couple said fuse assembly within said circuit;

said fuse element, disposed within said chamber and secured between said first and second posts by said fuse-securing means at a fuse-operable condition, being rupturable at an overcurrent condition above said predetermined current level into a first segment and a second segment at each of said respective first and second posts, which segments are separable within said chamber so as to inhibit arcing between said fuse element segments; and indicating snubber means movable within said housing between a first position at which said snubber means is disposed in contact with said fuse element when said fuse element is in a nonruptured intact condition, and a second position at which said snubber means envelops at least one of said first and second conducting posts when said fuse element is in said ruptured condition so as to separate said ruptured segments of said fuse element so as to prevent said arcing between said fuse element segments.

2. A fuse assembly as claimed in claim 1, wherein said housing has a base and a cover matable with said base which base and cover cooperate to provide said housing and chamber;

said first and second conducting posts mounted in and extending through said base.

3. A fuse assembly as claimed in claim 2, wherein:

said cover defines at least one well generally aligned with said conducting posts; and wherein said indicating snubber means is positioned within said at least one well and contacting said fuse element at said fuse-operable condition so as to provide a shear force thereon, said snubber means being operable to move against said fuse element at its rupture so as to contact said base and to separate said first and second fuse-element segments so as to prevent said arcing therebetween.

4. A fuse assembly as claimed in claim 3, wherein said cover has a transparent window for viewing said snubber means.

5. A fuse assembly as claimed in claim 3 wherein said housing has a first well aligned with one of said first and second posts and a second well aligned with the other of said first and second posts;

a first and second snubber means positioned in each of said first and second wells, respectively, and contacting said fuse element generally above said respective first and second posts, which first and second snubber means are operable to move and separate the respective fuse segments at said first and second posts at fuse element rupture to inhibit arcing.

6. A fuse assembly as claimed in claim 3 wherein said snubber means are ceramic.

7. A fuse assembly as claimed in claim 3 further comprising means for biasing positioned in said at least one well and operable to bias said snubber means against said fuse element.

8. A fuse assembly as claimed in claim 3 wherein said snubber means is a cylinder, which cylinder has a bore operable to receive said conducting post at fuse element rupture.

9. A fuse assembly as claimed in claim 3 wherein said snubber means is a generally U-shaped member with a first leg, a second leg and means for coupling said first and second legs, which coupling means has a top wall;

said first and second legs are generally parallel and define a gap therebetween;

a stub shaft mounted on said top wall extends into said well at said fuse-operable position;

at least one of said first and second legs contacting said fuse element of said fuse-operable position, and movable to contact said base at a fuse-inoperable position.

10. A fuse assembly as claimed in claim 9, further comprising means for biasing said snubber means, said biasing means positioned in said well and contacting said top wall to bias said snubber means against said fuse element and to contact said base at the fuse-inoperable position.

11. A fuse assembly, comprising:

a base;

a cover, having at least one indicator well, matable with said base, wherein said cover and base cooperate so as to define a housing with a cavity;

a first conducting post and a second conducting post, each of said posts having a first end and a second end;

said of said first and second posts being mounted within and extending through said base with one of said first and second post ends being disposed within said cavity;

at least one indicating snubber being positioned within said at least one indicator well and generally aligned with one of said first and second conducting posts;

a fuse element disposed within said cavity and coupling said one end of said first and second conducting posts, which fuse element ruptures so as to open a circuit between said posts, said fuse element retaining said snubber within said well at a fuse operative position; and biasing means disposed within said well for biasing said snubber so as to contact said fuse element at said operative position and for moving said indicating snubber from said well so as envelop at least one of said first and second conducting posts when said fuse element ruptures so as to separate ruptured segments of said fuse element so as to prevent arcing between said fuse element segments and to indicate fuse-element rupture and fuse-assembly inoperability.

12. A fuse assembly as claimed in claim 11 wherein said cover comprises a first indicator well and a second indicator well, each of said first and second wells having a sealed end and an open end communicating with said cavity, said first conducting post generally aligned with one of said first and second wells and said second conducting post generally aligned with the other of said first and second wells;

a first snubber and a second snubber positioned in said first and second wells, respectively;

means for biasing in each of said first and second wells to maintain said snubbers, disposed in said wells, against said fuse element at an operating position, said biasing means biasing said indicators to isolate said aligned conducting post at fuse-element rupture to prevent arcing and to indicate an inoperative mode.

13. A fuse assembly as claimed in claim 12 wherein said cover is translucent.

14. A fuse assembly as claimed in claim 11 further comprising a window in one of said cover and at least one well for visual observation of said fuse indicator at the fuse-operable position.

15. A fuse assembly as claimed in claim 12, further comprising a pedestal with an upper surface mounted on said base between said first and second conducting posts;

said fuse element spaced from said upper surface at said fuse operative position, which fuse element is rupturable into a first segment and a second segment at said first and second posts, respectively;

said pedestal increasing the separation distance between said first and second segments along said base to inhibit arcing at fuse rupture.

16. A fuse assembly as claimed in claim 15 wherein said cover is translucent.

17. A fuse assembly as claimed in claim 12 further comprising a window in each of said wells for observation of said snubbers in said walls.

18. A fuse assembly as claimed in claim 11 wherein said snubber is an insulating material.

19. A fuse assembly as claimed in claim 12 wherein said means for biasing is a spring positioned in said well between said cover and said snubber.

20. A fuse assembly as claimed in claim 11 wherein said well has a sealed end and an open end communicating with said cavity;

said snubber is positioned in said well and aligned with one of said conducting posts, which snubber is a cylinder;

biasing means is disposed in said well biasing said snubber at fuse-element rupture to envelop and isolate said aligned conducting post and ruptured element to prevent arcing.

21. A fuse assembly as claimed in claim 20 wherein said cylindrical indicator has a longitudinal axis, a first end with a first blindhole bore, and a second end with a second blindhole bore, said first and second blindhole bores are aligned along said axis with a separating wall therebetween, and one of said first and second bores is operable to mate with said conducting post and the other of said first and second bores is operable to receive said biasing means.

22. A fuse assembly as claimed in claim 11 where said snubber has an arm with an upper surface and a lower surface, a protuberance extending from said upper surface for mating with said well, at a fuse-operating position;

said biasing means is positioned between said cover and said upper surface to bias said indicator against said fuse element;

said snubber arm has a first end with a first tongue extending from said arm lower surface and a second end with a second tongue extending from said arm lower surface, said first and second tongues being generally parallel to and aligned with said first and second conducting posts, respectively; and said snubber is biased to position said first and second tongues between said first and second conducting posts at fuse element rupture.

23. A fuse assembly as claimed in claim 21 wherein said snubber is a dielectric material.

24. A fuse assembly as claimed in claim 11 wherein said snubber has an arm with an upper surface and a lower surface, a protuberance extends from said upper surface for slidably mating with said well at a fuse-operating position, said biasing means is positioned between said cover and said protuberance to bias said snubber against said fuse element, said arm having a first end with a first cup-shaped enclosure extending from said arm lower surface and a second end with a second cup-shaped enclosure extending from said arm lower surface, which enclosures are aligned with said first and second posts, respectively;

said first and second cup-shaped enclosures being matable with said first and second conducting posts at fuse element rupture.

25. A fuse assembly as claimed in claim 11 wherein said cover has an inner face, a first end and a second end, said snubber is an arm with an upper surface and a lower surface, a first cup-shaped end and a second cup-shaped end, each of said cup-shaped ends having a receptacle aligned and matable with a conducting post;

said arm having a saddle with a generally centrally-located protuberance extending from said arm upper surface;

said protuberance matable with said biasing means positioned between said cover inner surface and said arm upper surface to maintain said snubber in contact with said fuse element at said fuse operative position.

26. A fuse assembly as claimed in claim 11 wherein said cover has a window, a first sidewall and a second sidewall, each of said first and second sidewalls defining a pivot detent which detents are juxtaposed in said cavity;

said snubber having a first end cap, a second end cap and means for pivoting, a first leg and a second leg coupling said first and second end caps, respectively to said pivoting means;

said pivoting means positioned and pivotable in said detents;

said means for biasing maintaining one of said first and second end caps in contact with said fuse element and visible in said window, and the other of said first and second end caps maintained in proximity to one of said first and second posts at an operating position.

27. A fuse assembly as claimed in claim 26, wherein said visible end cap has a downwardly-extending arm contacting said fuse element to maintain said snubber at said operation position.

28. A fuse assembly as claimed in claim 27 wherein said first and second end caps, said base and said cover are dielectric materials.

29. A fuse assembly as claimed in claim 28 wherein said cover is a translucent material.

30. A fuse assembly as claimed in claim 11 further comprising a cylindrical well wall;

a translucent lens mounted in said cylindrical well wall for observation of said indicator at said fuse-operable position in said well.

31. A fuse assembly as claimed in claim 30 wherein said biasing means is a coil spring.

32. A fuse assembly as claimed in claim 11 further comprising a generally centrally-located well with a sealed end and an open end communicating with said cavity, said biasing means positioned in said well biasing said indicator against said fuse element at said operable position and to said inoperative position at fuse rupture.

33. A fuse assembly as claimed in claim 32 wherein said biasing means is a coil spring.

34. A fuse assembly comprising:

a base;

a cover having an upper surface, a first arc-shaped portion and a second arc-shaped portion, said arc-shaped portions centrally converging at a tangent point;

said cover and said base cooperating to define a housing with a cavity;

a first conducting post and a second conducting post, each of said posts having a first end and a second end, said first and second posts mounted in said base with one of said first and second ends of each post extending into said cavity and generally aligned with an arc shaped portion of said upper surface of said cover and the other of said ends protruding outside said base;

a fuse element coupling said first and second posts in said cavity;

a snubber having means for pivoting, a first end cap and a coupling arm, a second end cap and a second coupling arm, each of said first and second end-cap coupling arms connected to said means for pivoting;

said cover having a first detents and a second detent, said means for pivoting positioned in said first and second detent to allow said snubber to pivot in said cavity between a fuse-operable position and fuse-inoperable position;

means for biasing positioned between said snubber and said upper surface and operable to pivot said snubber and capture one of said conducting terminals in one said first and second end-caps and to position the other of said first and second end-caps at said upper surface at fuse-element rupture..

35. A fuse assembly as claimed in claim 34, further comprising a lens mounted in said cover for observing said snubber.

36. A fuse assembly as claimed in claim 34 wherein each of said first and second snubber end-caps has a pocket, one of said first and second end-cap pockets being disposed in proximity to one of said posts at said fuse inoperative position.

37. A fuse assembly as claimed in claim 34 wherein one of said snubber first and second end-caps is a substantially a rectangular paddle and the other of said first and second end caps is generally rectangular with a serpentine edge, which serpentine shape provides a foot to contact said base and isolate a conductor post at said inoperative position.

38. A fuse assembly as claimed in claim 1 wherein said housing is hermetically sealed.

39. A fuse assembly as claimed in claim 38 wherein said chamber is filled with a dielectric fluid to inhibit arcing.

40. A fuse assembly for an electrical circuit, comprising:

a housing having a chamber and a wall with an external surface;

a fuse element rupturable at an electric current level above a predetermined current level;

a first conducting post and a second conducting post, each of said conducting posts having a first end and a second end, at least one of said first and second ends of each of said posts having means for securing said fuse element thereto;

said first and second conducting posts extending through said wall with said fuse-securing-means end positioned within said chamber and the other one of said ends operable to couple said fuse assembly within said circuit;

said fuse element, disposed within said chamber and secured between said first and second posts by said fuse-securing means at a fuse-operable condition, being rupturable at an overcurrent condition above said predetermined current level into a first segment and a second segment at each of said respective first and second posts, which segments are separable within said chamber so as to inhibit arcing between said fuse element segments; and indicating snubber means movable within said housing between a first position at which said snubber means is disposed in contact with said fuse element when said fuse element is in a nonruptured intact condition, and a second position at which said snubber means spans a gap defined between said first and second conducting posts when said fuse element is in said ruptured condition so as to separate said ruptured segments of said fuse element so as to prevent said arcing between said fuse element segments.

* * * * *